US005511295A

United States Patent [19]

Shah

[11] Patent Number: 5,511,295

[45] Date of Patent: Apr. 30, 1996

[54] SYSTEM FOR PREPARING HIGHLY COHERENT AIR JET TEXTURED YARN

[75] Inventor: Jagdish N. Shah, Hockessin, Del.

[73] Assignee: E. I. du Pont de Nemours and Company, Wilmington, Del.

[21] Appl. No.: 405,041

[22] Filed: Mar. 15, 1995

[51] Int. Cl.[6] ..... D02G 1/16

[52] U.S. Cl. ..... 28/254; 28/273

[58] Field of Search ..... 28/254, 271, 273

[56] References Cited

U.S. PATENT DOCUMENTS

| | | | |
|---|---|---|---|
| 3,881,231 | 5/1975 | Price et al. | 28/1.4 |
| 4,104,770 | 8/1978 | Massey, Jr. et al. | 28/273 X |
| 4,157,605 | 6/1979 | Agers | 28/273 X |
| 4,183,123 | 1/1980 | Tanaka et al. | 28/273 |
| 4,290,177 | 9/1981 | Price et al. | 28/273 X |
| 4,922,593 | 5/1990 | Gorrafa | 28/273 X |
| 4,945,618 | 8/1990 | Gorrafa | 28/254 |
| 5,020,199 | 6/1991 | Gorrafa | 28/273 |
| 5,140,729 | 8/1992 | Simmen | 28/273 X |
| 5,241,730 | 9/1993 | Simmen et al. | 28/273 |

*Primary Examiner*—John J. Calvert

[57] ABSTRACT

In a system for air-jet texturing yarn a yarn treating jet is modified to locate a baffle at the outlet end of the jet. The baffle is positioned a fixed distance from the central axis of the jet and away from the outlet end of the jet such that the yarn follows the surface of the baffle to a point where the yarn leaves the baffle to pass back through the air stream exiting the jet to eliminate partially textured yarn that normally forms when stopping the system.

9 Claims, 3 Drawing Sheets

SYSTEM FOR PREPARING HIGHLY COHERENT AIR JET TEXTURED YARN

BACKGROUND OF THE INVENTION

This invention relates to a system for preparing highly coherent textured yarn, and more particularly, it relates to a system for preparing such yarns with pressurized fluid in a jet having a deflector arrangement at its outlet end.

It is known to overfeed one, or more, ends of continuous multifilament yarns to a jet, in which pressurized fluid, such as air, acts on the filaments to splay them, curl them into crunodal loops, and entangle the looped filaments into coherent yarn.

Fluid jet processes are also known for texturing or bulking yarn that employ both movable and fixed baffles positioned at various distances from the outlet end of the jet and at various angles to the yarn path to deflect yarn and fluid from a straight path as they leave the jet.

In making a yarn having crunodal loops, the texturing jet must forward the overfed yarn under sufficient tension to keep the yarn from wrapping on the feed rolls, and this tension is provided by the drag of the pressurized air which is moving much faster than the yarn. The air opens the yarn, whips the filaments about, forms loops in the filaments, then entangles them together into a structure which can retain the loops under the tensions which such yarns encounter when made into fabrics. The tension must be low at the jet exit to accumulate loops and form the entangled structure. Immediately thereafter, higher tension is desired to tighten the entangled structure and stabilize it.

A baffle against which the air and yarn impinge is often provided at the jet exit to provide a controlled air zone and to change the direction of yarn movement abruptly. Such baffles are especially necessary at high texturing speeds and air pressures. However, with known baffle arrangements, the air divides around the baffle, and the portion of the air which follows the yarn continues to exert tension.

Textured yarn uniformity, in terms of appearance and loop stability, is highly critical for good fabric uniformity. Since many different packages are used to make fabrics, the yarn character must be the same from one package to the next and within a package from beginning at the core to the surface, including when a package is stopped for any reason.

A texturing position stops when either a take-up package is full or the feeder yarn supply is interrupted. In other cases, the positions are stopped at the time of shift change. The stop could be initiated either automatically or manually. In either case, the electric power that drives the motor and the rolls stops. The rolls continue to turn slowly, due to the inertia, before gradually slowing down and coming to a complete stop. When the rolls are completely stopped with no yarn movement through the jet, then the air supply to the jet is stopped, either automatically or manually, usually within 1–3 seconds. Stoppage of air prior to the stoppage of the rolls would result in totally untextured yarn, since the slow forward movement of rolls will continue to feed yarn to the jet without any air to texture it.

Textured yarn manufacturers have experienced small lengths of yarn (1 to 12 inches out of total approximately 500 inches of yarn during which the rolls slowly come to a full stop) with a varying degree of fluffy and partially or poorly textured yarn character immediately prior to stoppage of the rolls. This defect is called Partially Textured Yarn Defect or PTYD. The PTYD consists of loosely bulked or fluffed yarns having insufficient filament mixing and loop interlocking so that the yarn bulk will pull out easily and will show as defects in the fabric. Although the defect is present in a majority of the commercial texturing processes, the severity of PTYD varies, depending upon actual texturing process conditions. For years, the texturizers have coped with the problem by either (A) cutting off PTYD manually prior to re-string up or (B) leaving the PTYD at the core of a new package and rejecting the "heel" as waste in subsequent process. Both solutions are inefficient, wasteful, and subject to operator judgment and error.

SUMMARY OF THE INVENTION

The present invention is a system for texturing one or more yarns that includes a source of supply for said yarns, a yarn texturing jet through which yarn passes positioned between a feed means and a take-up means for taking textured yarn up onto a package. The jet includes a body having yarn inlet and outlet ends connected by a central bore along a central axis, means for introducing pressurized gas through a gas inlet into said bore between said ends to contact yarn passing through the jet at a location in said bore, said yarn and said gas following a path from said outlet end of said jet. A baffle is located adjacent the yarn outlet end of the jet, the baffle has a peripheral surface, the portion of the surface nearest said outlet end is a distance of 0.5 to 1.5 minimum diameters of the bore downstream of said location where the pressurized gas enters into the bore of the jet and the portion of the baffle surface nearest the central axis is a distance of from 0.7 to 2.5 of said minimum diameters from said central axis.

The baffle may have a circular, curvilinear, or polygon cross section.

In operation, upon exiting the jet orifice, the yarn travels axially straight out along with the exhaust air stream, and then sharply changes direction, forming a bend while the exhaust air continues its forward path. The yarn then continues to follow the contour of the baffle and travels back through the exhaust stream toward the take-up means.

DETAILED DESCRIPTION OF THE PREFERRED EMBODIMENT

Figure 1:
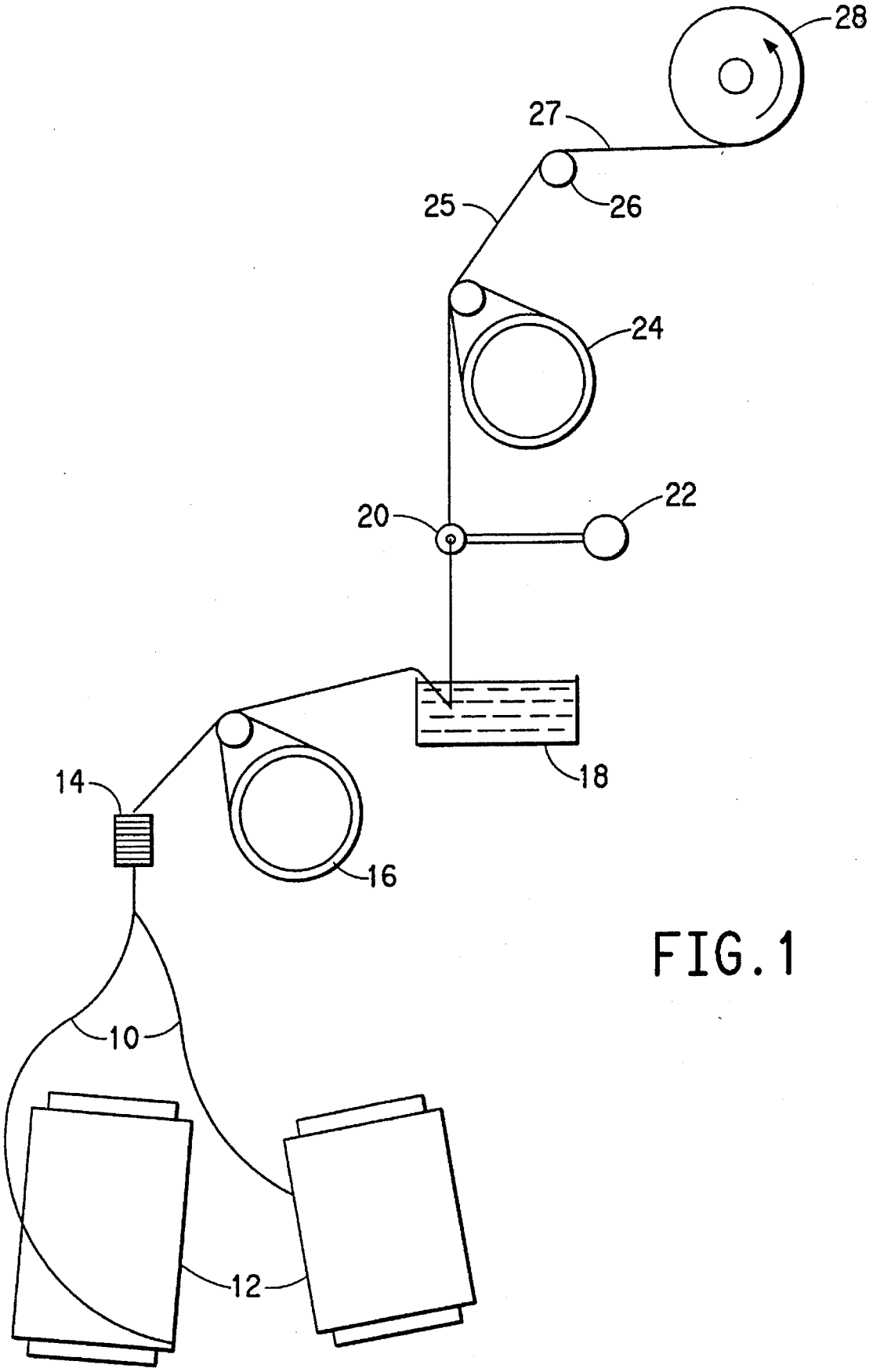
FIG. 1 is a schematic illustration of one embodiment of the system of this invention.

In an embodiment chosen for purposes of illustration, in FIG. 1, feed yarns 10 from a plurality of packages 12, are threaded through tensioner 14 and feed roller 16 to a wetting bath 18 to the inlet of texturing jet 20. Jet is supplied by compressed air from air manifold 22.

Textured yarn exiting jet 20, around special baffle fitted to jet exit (not shown), is taken to nip roll 24, over traverse guide bar 26, onto wind up package 28. Speed of feed roll 16 is greater than nip roll 24 to effect a yarn bulking overfeed of from about 5 to about 200% or more. Wind up speed is slightly faster than nip roll 24 speed by about 1 to about 10% or more. Wind up tension is measured, by a suitable tensiometer, at location 25 on textured yarn 27, and an average reading is taken to avoid tension extremes generated by traversing the yarn onto take-up package.

In core-and-effect texturing, effect yarn (not shown) ends are fed to separate feed roll before running through jet 20 commonly without getting wetted. Yarn ends 10 from supply packages 12 taken to feed roll 16 serve as core. Core-and-effect ends are textured together by jet 20 but to different levels of overfeeds. A low overfeed level is applied to core yarn ends 10 by the speed ratio of rolls 16 and 24. A high overfeed level is applied to effect yarn ends by the speed ratio of their corresponding rolls.

In parallel yarn texturing the level of overfeed is the same for each yarn fed to the jet.

Commercial machine of the type shown in FIG. 1 is an Eltex AT, manufactured by Hirschburger GMBH of Reutlingen, Germany.

Figure 2:
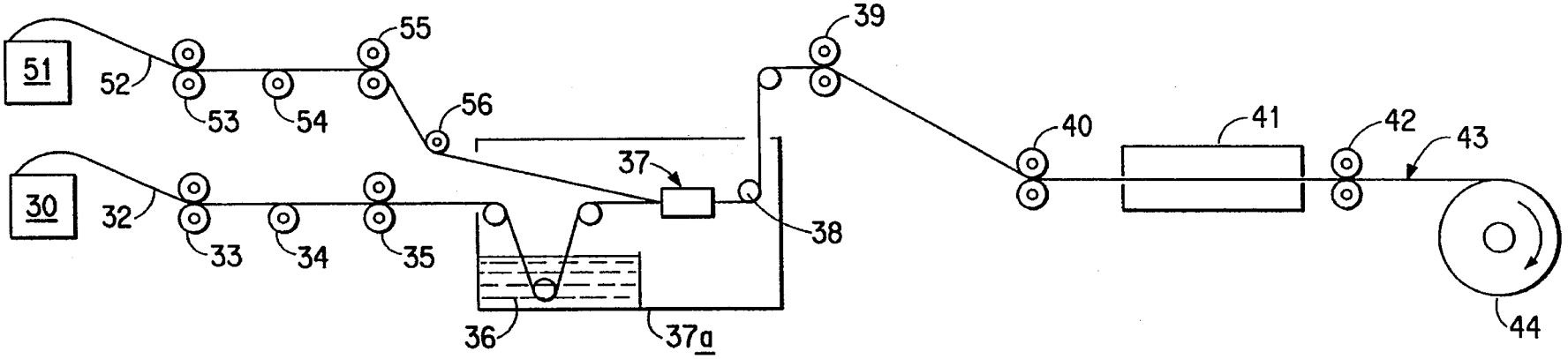
FIG. 2 is a schematic illustration of an alternate embodiment of the system of this invention.

A more detailed system is shown in FIG. 2 wherein feed yarn packages 30 (one is shown) supply multifilament yarn ends 32 to feed rolls 35, which, in turn, overfeed the yarns to jet 37, after passing through water bath 36 both contained in compartment 37*a*. If feed yarns 32 are polymeric, such as polyester or polyamide, spun without being fully oriented (known in the industry as POY yarn, for being partially oriented yarn), it is common to draw said feed yarn in a drawing zone between rolls 33 and rolls 35. If yarn is polyester POY, it is common to draw it around a hot metallic pin 34, located between rolls 33 and 35. After feeding yarns to jet 37, textured yarn exits the jet around cylindrical baffle 38 to rolls 39. A mild cold stretching of 1 to 15% is sometimes applied in the zone between rolls 39 and rolls 40, often called the stabilization zone. High yarn shrinkage, either inherent in the supply feed yarn or generated by the drawing step between rolls 33 and rolls 35, is sometimes reduced by yarn relaxation step between rolls 40 and rolls 42 wherein yarn travels through heated tube 41. After exiting rolls 42, textured yarn is wound around take-up package 44. Wind up tension is measured at location 43, as far upstream of textured package 44 as possible, to reduce tension peaks generated by traversing the yarn in winding. An average tension reading is taken. Tension can also be measured in stabilization zone between rolls 39 and rolls 40 to evaluate the effectiveness of the texturing jet 37. Under otherwise identical speed ratios and conditions, the higher the tension in the stabilization zone, the more effective the jet 37 is in converting bulking overfeed to stable, more highly coherent, and bulky textured yarn.

For core-and-effect texturing, core yarns 32 (only one shown in FIG. 2) are fed through rolls 33 and 35 to water bath 36 and texturing jet 37 (FIG. 2). Effect yarns 52 from supply packages 51 (only one is shown in FIG. 2) are fed through rolls 53 and rolls 55 for drawing on hot pin 54 before guiding them around bar 56 to inlet of texturing jet 37. Commonly, core yarns 32 are wetted in bath 36 but effect yarns 52 are not wetted, by bypassing the bath. In other arrangements, wetting the core yarn 32 is done by dripping liquid from a suitable orifice (not shown) onto the yarn directly. A typical machine similar to that schematically shown in FIG. 2 is model FK6-T80, manufactured by Barmag Co., of Remscheid, Germany.

Figure 3:
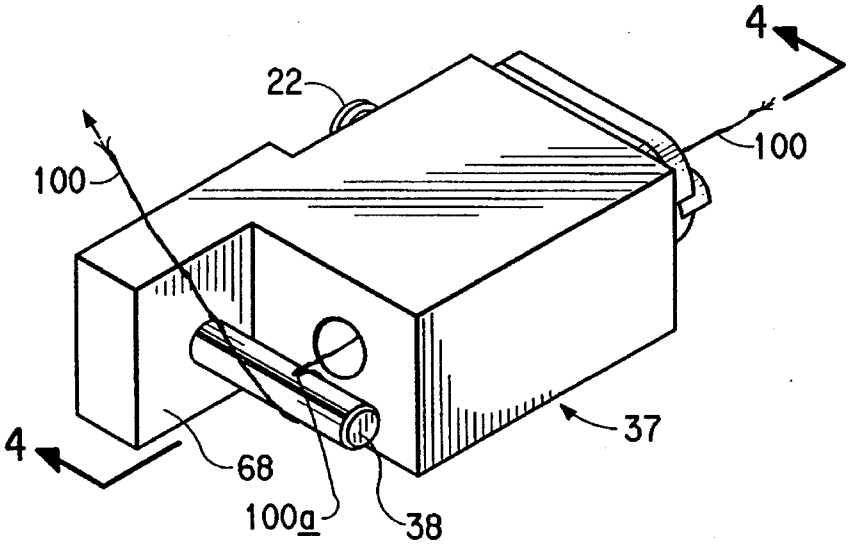
FIG. 3 is a perspective view of the jet used in this invention.
Figure 4:
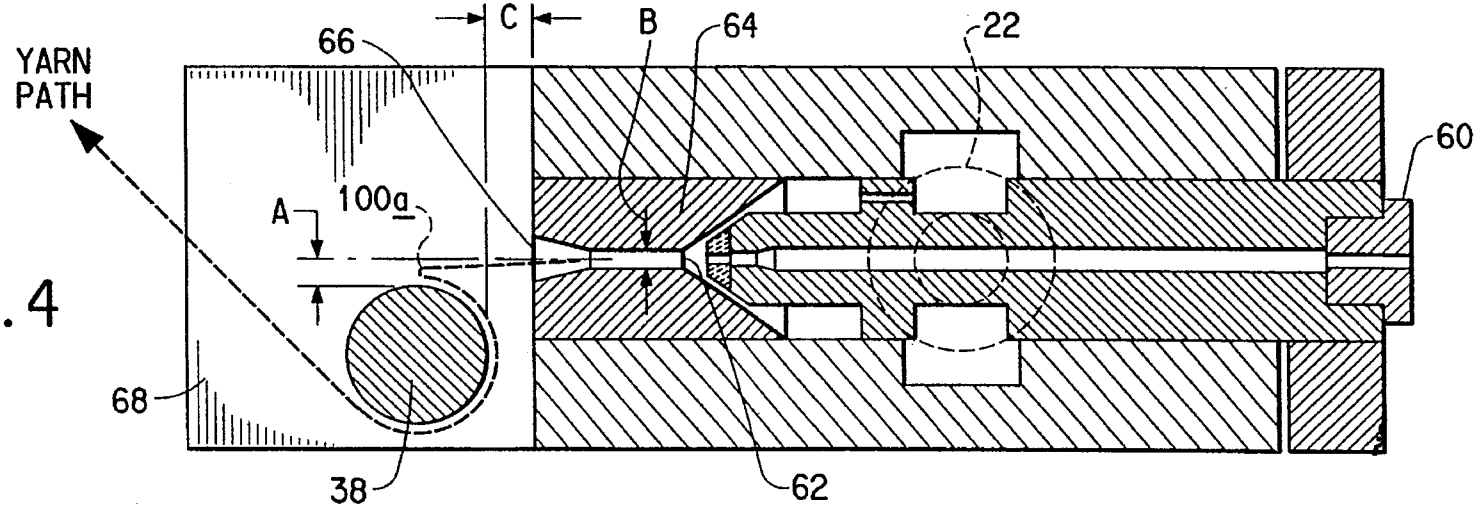
FIG. 4 is a sectioned view of FIG. 3 taken along line 4—4.

Texturing jet 37, with special exit baffle, is described in FIGS. 3 and 4.

In the system of this invention, POY feed yarns are not specifically necessary, but if used, it is common to pre-draw the yarn, with or without heat, before reaching pre-jet feed rolls. Also, a stabilization zone is not specifically necessary, but could be used. Also, a heat setting zone, shown between rolls 40 and 42, is not specifically necessary but could be used to modify thermal properties of textured yarn, e.g., boil off shrinkage.

The system of this invention is applicable to all types of filament yarns such as polyester, POY polyester, nylon, POY nylon, polypropylene, POY polypropylene, polyolefin, rayon acetate, glass, and aramid yarns.

The system of this invention is also applicable to yarn manufactured with free-end broken filaments protruding from yarn bundle, in which loops generated by texturing jet 37 are subsequently broken or abraded to single filaments so that yarn produced resembles a hairy spun yarn.

A closer view of the jet 37 in FIGS. 3 and 4 shows either yarn 10 (FIG. 1), or the combination of yarns 32 and 52 (FIG. 2) generally designated 100 enter the jet through inlet 60. Compressed air or other pressurized gas enters the jet through pipe 22 and impinges on the yarn in the entrance 62 of yarn outlet orifice block 64. The yarn and high velocity gas travel together through outlet end 66 of the jet and travel around baffle 38 which is fixedly mounted to bracket 68 attached to the outlet end of the jet.

The central axis of cylindrical baffle 38 is located with respect to the central axis of the jet such that the portion of the surface of the baffle nearest the central axis of the jet device is a distance A of from 0.7 to 2.5 minimum diameters of the bore downstream of the location where the pressurized gas contacts the yarn in the bore. More particularly, in the yarn outlet orifice block 64, said minimum diameter is the diameter indicated at location B. The baffle is also located a fixed distance C from the outlet end 66 of the jet's exhaust. This distance C is in the range of from 0.1 to 4.0 and is preferably in the range of from about 0.5 to about 1.5 of the minimum diameters referred to above.

In operation, yarn is passed through jet 37 where it is treated with pressurized gas, then propelled by the gas from the outlet end of the jet. Upon exiting the jet, the yarn travels axially straight out along with the exhaust air stream and then sharply changes direction forming a bend 100*a* while the air stream continues its forward path. The yarn then follows the contour of the baffle back through the air stream toward the take-up means.

EXAMPLE 1

One end of 300 denier—72 filament polypropylene yarn as core and two ends of the 300 denier—72 filament polypropylene yarns as effect, are fed into an air jet texturing jet as shown in FIGS. 2, 3, and 4. Size of minimum diameter B in FIG. 4 is 0.078 inches and needle has a central hole for yarn passage of 0.033 inches in diameter and air inlet hole of 0.093 inches in diameter. Core yarn overfeed between rolls 35 and 39 in FIG. 2 is +10%, effect yarn overfeed between rolls 55 and 39 is +30% to +118%. The underfeed to the wind up between rolls 39 and 44 is −5%. Distance C is 0.060 inches and the diameter of the baffle is 0.400 inches. Distance A is varied from −0.450 to +0.299 inches, where negative (−) sign indicates baffle surface above the jet axis. The textured yarn is wound up onto a package 44 at 280 meters per minute. The air pressure to the jet 37 is 130 psi and the air flow is 10 cubic feet per minute.

Presence of PTYD and severity are observed when the rolls and the air supply are stopped as normal practice. The unique relationship of the baffle to the yarn passageway in the system of this invention totally eliminated partial textured yarn defect under a wide range of texturing conditions as noted in Table I. By contrast, other baffle positions and yarn passageway, as practiced in the industry, show presence of PTYD.

TABLE I

| DISTANCE A | PRESENCE OF PTYD (YES/NO) AT EFFECT YARN OVERFEED OF | | |
|---|---|---|---|
| (INCHES) | +30% | +57% | +118% |
| −0.450 | Yes | Yes | Yes |
| −0.200 | Yes | Yes | Yes |
| −0.021 | Yes | Yes | Yes |
| +0.050 | Yes | Yes | Yes |
| +0.086 | No | No | No |
| +0.121 | No | No | No |
| +0.157 | No | No | No |
| +0.193 | No | No | No |
| +0.228 | Yes | Yes | No |
| +0.264 | Yes | Yes | No |
| +0.299 | Yes | Yes | No |

EXAMPLE 2

Four ends of 150 denier—34 filament polyester yarn as parallel ends are fed into an air jet texturing jet as shown in FIGS. 1, 3, and 4. Size of minimum diameter B in FIG. 4 is 0.070 inches, and the needle has a central hole for yarn passage of 0.033 inches in diameter yarn overfeed between rolls 16 and 24 in FIG. 2 is 26% and between rolls 16 and wind up 28 is 19.5%. Distance C is 0.060 inches and the diameter of the baffle is 0.400 inches. Distance A is varied similar to Example 1. The textured yarn is wound up onto a package 28 at 280 meters per minute. The air pressure to the jet is 130 psi and air volume is 9 cfm.

The elimination of the PTYD is indicated in Table II.

TABLE II

| DISTANCE A (INCHES) | PRESENCE OF PTYD (YES/NO) |
|---|---|
| −0.450 | Yes |
| −0.200 | Yes |
| −0.164 | Yes |
| −0.093 | Yes |
| −0.039 | Yes |
| −0.004 | Yes |
| +0.050 | No |
| +0.085 | No |
| +0.157 | No |
| +0.228 | No |
| +0.299 | No |

What is claimed is:

1. In a system for texturing one or more yarns that includes a source of supply for said yarns, a yarn treating jet positioned between a feed roll and a nip roll through which yarn passes for treating with pressurized fluid and means for taking yarn up onto a package under tension, said jet including a body having inlet and outlet ends connected by a central bore along a central axis, means for introducing pressurized gas through a gas inlet into said bore between said ends to contact yarn passing through the jet at a location in said bore, said yarn and said gas following a path from said outlet end of said jet, the improvement comprising: a baffle located adjacent the yarn outlet end of the jet, said baffle having a peripheral surface, the portion of said surface nearest said outlet end being a distance of 0.1 to 4.0 minimum diameters of the bore downstream of said location, the portion of said surface nearest said central axis being a distance of from 0.7 to 2.5 of said minimum diameters from said central axis said baffle providing a guiding surface means for said yarn for sharply changing direction of said yarn so as to a bend and for directing the yarn back through said gas flowing in said path after said yarn leaves the outlet end of the jet onto the guiding surfaces means of the baffle and back through the gas following in said path toward said means for taking yarn up onto a package.

2. The system of claim 1, said baffle being cylindrical.

3. The system of claim 1, including means for applying liquid to said yarn between said feed roll and the yarn inlet of the jet body.

4. The system of claim 3, wherein said means for applying liquid is a water bath, said yarn being immersed in said water prior to passing to the jet.

5. The system of claim 3, including means for drawing said yarn located between said source of supply for said yarns and said means for feeding yarn to applying liquid to said yarn, and means for stabilizing said yarn, by stretching said yarn in a stabilization zone from about 1 to about 15 percent said zone being located between said nip rolls and said means for taking yarn up onto a package.

6. The system of claim 5, including means for post heating said yarn in a zone downstream of said stabilization zone.

7. The system for texturing one or more yarns of claim 1, wherein said texturing is core-and-effect texturing, said effect yarn being overfed at an overfeed level of 118%, the position of said surface nearest said central axis being a distance of from 0.7 to 4.0 of said minimum diameters from said central axis.

8. The system of texturing one or more yarns of claim 1, wherein said texturing is parallel yarn texturing said parallel yarn being overfed at the same overfeed level to the jet, the position of said surface nearest said central axis being a distance of from 0.7 to 4.3 of said minimum diameters from said central axis.

9. The system for texturing one or more yarns of claim 1, wherein said position of the surface nearest the outlet end is a distance of 0.5 to 1.5 minimum diameters of the bore downstream of said location.

* * * * *